United States Patent [19]

Eblen et al.

[11] Patent Number: 4,909,446

[45] Date of Patent: Mar. 20, 1990

[54] FUEL INJECTION NOZZLE FOR INTERNAL COMBUSTION ENGINES

[75] Inventors: Ewald Eblen, Stuttgart; Rolf J. Giersch, Eberdingen; Karl Hofmann, Remseck, all of Fed. Rep. of Germany

[73] Assignee: Robert Bosch GmbH, Stuttgart, Fed. Rep. of Germany

[21] Appl. No.: 243,299

[22] PCT Filed: Jan. 10, 1987

[86] PCT No.: PCT/DE87/00009

§ 371 Date: Aug. 17, 1988

§ 102(e) Date: Aug. 17, 1988

[87] PCT Pub. No.: WO87/05077

PCT Pub. Date: Aug. 27, 1987

[30] Foreign Application Priority Data

Feb. 17, 1986 [DE] Fed. Rep. of Germany ..... 3604907

[51] Int. Cl.[4] ..... F02M 61/06

[52] U.S. Cl. ..... 239/533.12

[58] Field of Search ..... 239/453–456, 239/460, 533.3–533.12

[56] References Cited

U.S. PATENT DOCUMENTS

| | | | |
|---|---|---|---|
| 2,263,197 | 11/1941 | Tabb et al. | 239/460 X |
| 4,082,224 | 4/1978 | Mangus | 239/533.12 X |
| 4,540,126 | 9/1985 | Yoneda et al. | 239/533.4 |
| 4,591,101 | 5/1986 | Fortnagel | 239/533.12 |

FOREIGN PATENT DOCUMENTS

| | | | |
|---|---|---|---|
| 2822675 | 11/1976 | Fed. Rep. of Germany | 239/533.4 |
| 3426951 | 1/1986 | Fed. Rep. of Germany . | |
| 59-9213 | 1/1983 | Japan . | |
| 1377441 | 2/1988 | U.S.S.R. | 239/533.12 |
| 2133833 | 7/1984 | United Kingdom . | |

*Primary Examiner*—Andres Kashnikow
*Assistant Examiner*—Kevin P. Weldon
*Attorney, Agent, or Firm*—Michael J. Striker

[57] ABSTRACT

Fuel injection nozzle for internal combustion engines comprising an inwardly opening valve needle (14) and a nozzle bore hole (20) into which a throttle pivot (18) of the valve needle (14) dips during an initial lift. The throttle pivot (18) is provided with at least two flattened portions (30, 32 and 30, 32, 40, respectively) for forming preferred pass-through cross sections in the nozzle bore hole (20), wherein at least two flattened portions (30, 32 and 32, 40, respectively) end in different cross-sectional planes of the throttle pivot (18). Accordingly, a step-wise enlargement of the total cross section in the nozzle bore hole (20) can be achieved during the initial lift of the valve needle (14) with manufacturing methods which can be controlled in a favorable manner.

4 Claims, 2 Drawing Sheets

FUEL INJECTION NOZZLE FOR INTERNAL COMBUSTION ENGINES

FIELD OF THE INVENTION

The present invention relates to a fuel-injection nozzle for an internal-combustion engine.

BACKGROUND OF THE INVENTION

A standard fuel-injection nozzle for an internal-combustion engine has a nozzle body formed with a bore in turn formed with a valve seat centered on an axis and tapered axially in a fuel-flow direction. This seat has relative to the direction an annular downstream edge. An axially displaceable valve needle has a surface engageable with and complementary to the seat and is formed with a throttle pin normally projecting axially into the bore past the seat edge. This needle lifts against the flow of fuel through the nozzle off the seat to permit the fuel to flow to the respective cylinder of the engine.

Such injection nozzles of this generic type have the advantage that the throughput cross section in the nozzle bore hole, which throughput cross section is formed by means of a flattened portion at the throttle pin, tends to gum up less than an annular gap between a fully cylindrical throttle pin and the nozzle bore. In a known injection nozzle of the generic type mentioned in German patent document No. 3,326,468 the flattened portion at the throttle pin is arranged so as to be inclined relative to the nozzle axis, so that the desired effect of an increasing pass-through cross section is produced until the emergence of the throttle pin from the nozzle bore. However, it is difficult to maintain the prescribed angular position of such a flattened portion in industrial-scale production and it can only be checked at increased cost, since the reference points must be maintained with extreme accuracy.

OBJECTS OF THE INVENTION

It is therefore an object of the present invention to provide an improved fuel-injection nozzle for an internal-combustion engine.

SUMMARY OF THE INVENTION

These objects are attained according to this invention by forming the pin of the needle with a pair of separate flats extending substantially parallel to the axis and spaced from the bore downstream of the seat edge. These flats terminate at respective upsteam ends at edges lying generally in planes perpendicular to the axis and axially spaced from each other.

This system has the advantage that an enlargement of the preferred pass-through cross section in the nozzle bore hole is achievable during the initial lift of the valve needle with steps which can be controlled and monitored in a favorable manner during production.

Two flattened portions of the throttle pin can be spaced at different distances relative to the nozzle axis, i.e. they can be ground in different depths, so that to the determined engine types in optimum fashion. In this case, the two flattened portions can be arranged so as to be offset relative to one another by an angle, preferably 180°, and can be constructed so as to have different lengths. This has the advantage that the radial forces exerted on the throttle pin by the fuel can be compensated to a great extent in the lift area in which the two flattened portions are effective.

In many cases, it can also be advantageous to arrange the two flattened portions axially one after the other and to let them pass into one another at a stepped edge. If necessary, more than two, e.g. three, flattened portions can be provided one after the other so that two transition steps are produced. In order to have a compensation of radial forces in this case, as well, it is further suggested to arrange another flattened portion, in addition to the flattened portions which are arranged axially one after the other, which flattened portion is preferably offset relative to the latter by 180°. But the flattened portions which are arranged axially one after the other can, of course, also be provided solely by themselves. In addition, one or more flattened portions can also be arranged diagonally relative to the nozzle axis.

DESCRIPTION OF THE DRAWING

The above and other objects, features, and advantages will become more readily apparent from the following, reference being made to the accompanying drawing in which.

SPECIFIC DESCRIPTION

Figure 1:
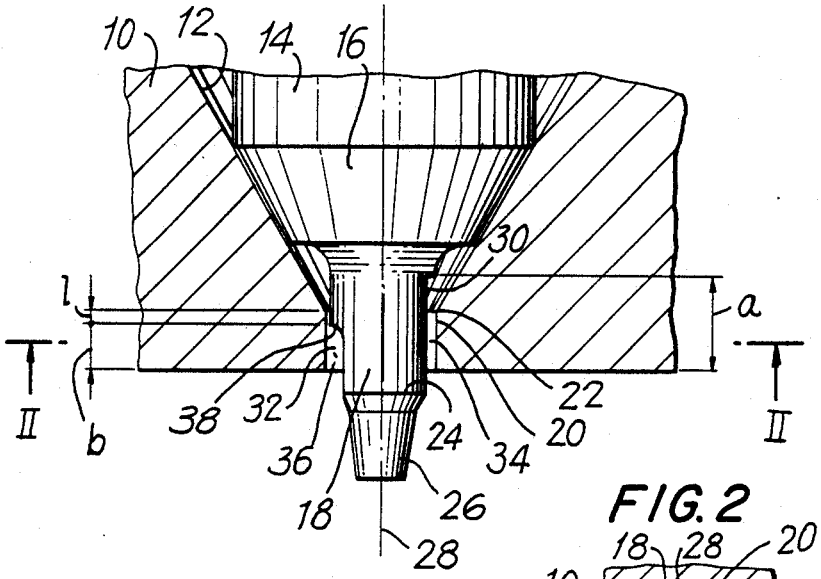
FIG. 1 is an axial section through a first embodiment of the nozzle according to this invention.
Figure 2:
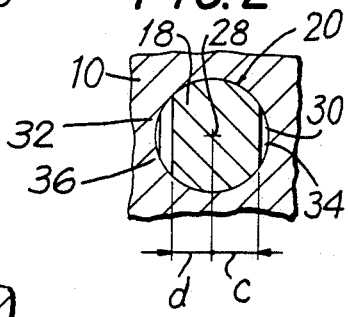
FIG. 2 is a cross section taken along line II—II of FIG. 1.

The injection nozzle, according to FIGS. 1 and 2, has a nozzle body 10 in which is formed a valve seat 12, which is directed against the fuel flow, a valve needle 14 being supported in the nozzle body 10 so as to be displaceable. This valve needle 14 forms a sealing cone 16 which cooperates with the valve seat 12, a throttle pin 18 adjoining the sealing cone 16 and projecting into a nozzle bore 20 which adjoins the valve seat 12. An annular edge 22 is formed at the nozzle body 10 at the transition between the valve seat 12 and the nozzle bore 20. An injection molded pivot 26 commencing at an annular edge is formed on at the throttle pin 18. The valve needle 14 is pressed against the valve seat 12 by a closing spring and is raised from the valve seat 12 by the fuel pressure which increases during the start of injection.

The throttle pin 18 is provided with two diametrically opposed flattened portions 30, 32 which extend parallel to the nozzle axis 28 form two preferred pass-through cross sections 34 and 36 in the nozzle bore 20. The two flattened portions 30, 32 proceed from the front annular edge 24 of the throttle pin 18 and have different lengths a, b, and are at different distances c, d relative to the nozzle axis 28. The length a of the flattened portion 30 is dimensioned in such a way that the pass-through cross section 34 is available alreadyin the closed position of the valve needle 14. The length b of the flattned portion 32 is dimensioned in such a way that the stepped edge 38 formed at the end of the flattened portion 32 is located above the annular edge 22 of the nozzle body 10 by an overlapping length 1 in the closed position of the valve needle 14.

The diameter of the throttle pin 18 is dimensioned so as to be smaller than the diameter of the nozzle bore hole 20 only by the amount of a necessary movement gap. The distance c of the longer flattened portion 30 from the nozzle axis 28 is selected such that the magnitude of the preferred pass-through cross section 34 approximately corresponds to the magnitude of the initial throttle gap of a conventional injection nozzle without flat surfaces at the throttle pin. During an initial lift of the valve needle 14 corresponding to the overlapping 1, the fuel reaches the combustion chamber of the engine through the pass-through cross section 34 so as to be throttled.

When the valve needle 14 has been moved upward by the distance 1, the second preferred pass-through cross section 36 is opened and the throttling of the outflowing fuel is considerably reduced. When the annular edge 24 of the throttle pin 18 reaches out over the annular edge 22 at the nozzle body 10 in the course of the opening lift of the valve needle 14, the main quantityof fuel is injected without throttling.

Figure 3:
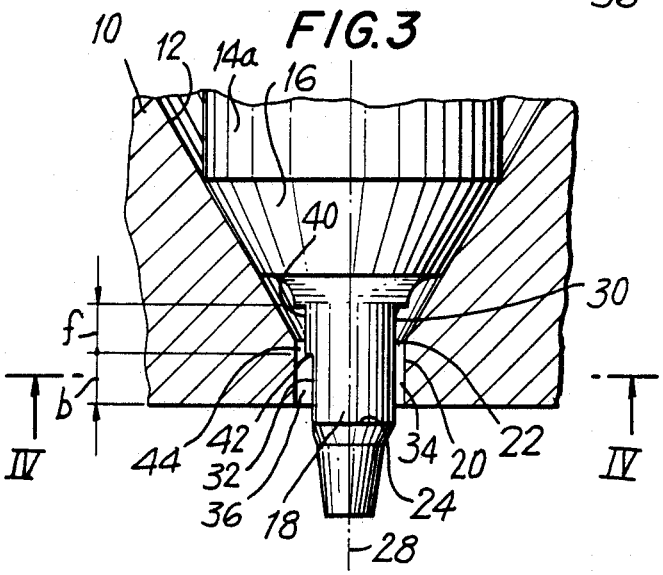
FIG. 3 is an axial section through a second embodiment of the nozzle.
Figure 4:
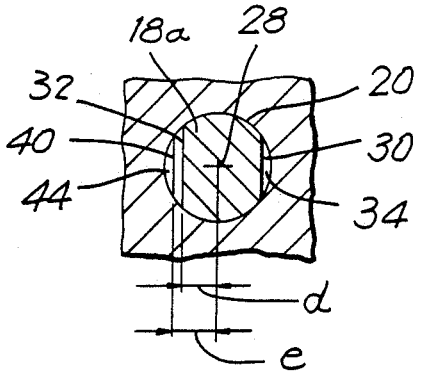
FIG. 4 is a cross section taken along line IV—IV of FIG. 3.

The embodiment, according to FIGS. 3 and 4, corresponds in terms of basic construction with the embodiment described above, so the same parts are provided with the same reference numbers. Here, however, the throttle pin 18*a* of the valve needle 14*a* is provided with another flattened portion 40 which axially adjoins the flattened portion 36. The flattened portion 40 is at a distance e from the nozzle axis 28 which approximately corresponds to the distance c of the opposite flattened portion 30. Accordingly, a stepped edge 42 is produced between the flattened portions 32 and 40 which is correspondingly lower than the stepped edge 38 of the throttle pivot 18. The length f of the flattened portion 40 is dimensioned in such a way that the latter ends in approximately the same cross-sectional plane of the throttle pin 18*a* as the flattened portion 30.

Another preferred pass-through cross section 44, which is located diametrically opposite to the pass-through cross section 34, results in the closed position of the valve needle 14*a* by means of the flattened portion 40. Accordingly, it is achieved that the radial forces exerted on the valve needle 14a by the fuel are eliminated to a great extent already at the start of injection.

Figure 5:
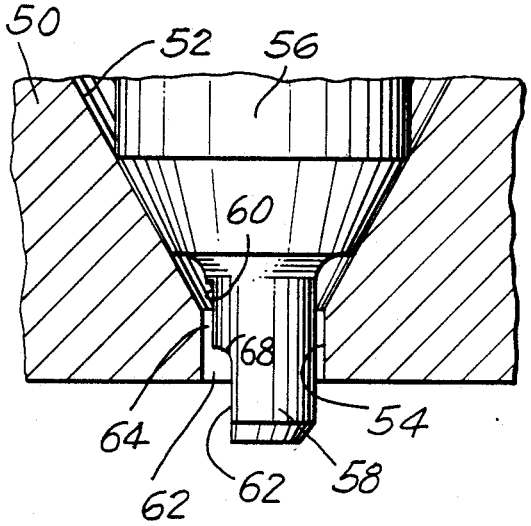
FIG. 5 is an axial section through a third embodiment of the nozzle.

In the injection nozzle, according to FIG. 5, a valve seat 52 and a cylindrical nozzle bore 54 are formed in a nozzle body 50, and a valve needle 56 is supported in the latter so as to be displaceable, which valve needle 56 comprises a throttle pin 58 projecting into the nozzle bore 54. This throttle pin 58 is dimensioned in length such that it projects a distance into the nozzle bore 54 during a full lift of the valve needle 56. The throttle pivot 58 is provided with two flattened portions 60, 62 which are arranged axially one after the other, one of which determines a throttle cross section 64, and the other determines an end cross section 66 in the nozzle bore hole 54. The transition 68 between the two flattened portions 60, 62 can be constructed as a groove or as a plane surface.

We claim:

1. A fuel-injection nozzle for an internal-combustion engine, the nozzle comprising:

a nozzle body formed with a bore in turn formed with a valve seat centered on an axis and tapered axially in a fuel-flow direction, the seat having relative to the direction an annular downstream edge; and an axially displaceable valve needle having a surface engageable with and complementary to the seat and formed with a throttle pin normally projecting axially into the bore past the seat edge, the pin being formed in turn with a pair of separate flats extending substantiallly parallel to the axis and spaced from the bore downstream of the seat edge, the flats terminating at upstream ends at edges lying generally in planes perpendicular to the axis and axially spaced from each other, whereby when the needle is lifted axially upstream from the seat first one of the flat edges passes the seat edge and then the other flat edge passes the seat edge, increasing the flow cross section through the bore in steps.

2. The fuel-injection nozzle defined in claim 1 wherein the flats are offset at different distances from the axis.

3. The fuel-injection nozzle defined in claim 2 wherein the flats are axially offset from one another and the upstream end of one of the flats constitutes a downstream edge of the other flat.

4. The fuel-injection nozzle defined in claim 1 wherein the needle is displaceable between a raised end position out of engagement with the seat but with the pin and at least one of the flats still projecting past the seat edge.

* * * * *